United States Patent [19]

Liu

[11] Patent Number: 4,777,071

[45] Date of Patent: Oct. 11, 1988

[54] STITCHLESS REINFORCED CORNER STRUCTURE FOR CLOTH

[76] Inventor: Cho Liu, 2, 3rd Fl., No. 151, shyue-Shih Rd., Taichung City, Taiwan

[21] Appl. No.: 50,193

[22] Filed: May 15, 1987

[51] Int. Cl.[4] ..... B32B 3/10

[52] U.S. Cl. ..... 428/120; 428/126; 428/124

[58] Field of Search ..... 428/126, 130, 120, 99, 428/137, 131, 124; 52/3, 4; 150/52 R

[56] References Cited

U.S. PATENT DOCUMENTS 2,667,353 1/1954 Lanice ..... 150/52 R 4,398,495 8/1983 Harris et al. ..... 428/131 X

*Primary Examiner*—Alexander S. Thomas

*Attorney, Agent, or Firm*—Kirschstein, Kirschstein, Ottinger & Israel

[57] ABSTRACT

A stitchless reinforced corner structure for cloth includes a foldable interlining member made of tough plastic material and integrally formed by injection, a pair of folding lines formed on a surface of the interlining member defining a middle region, a left region and a right region, a pair of annular openings respectively provided in an upper portion of the middle region and in an upper portion of the left region, a pair of stubs provided at a lower portion of the middle region, and orifices corresponding to the stubs formed respectively on the left and right region, so that, when the left and right region are folded over the middle region, the orifices and the stubs are closely engaged with each other so as to have a cloth corner tightly secured therein without the need for stitching.

4 Claims, 5 Drawing Sheets

STITCHLESS REINFORCED CORNER STRUCTURE FOR CLOTH

BACKGROUND OF THE INVENTION

1. Field of the Invention

This invention relates to a reinforced corner structure for cloth, and more particularly to that type of reinforced corner structure fitted in cloth without stitching for facilitating production automation and reducing working time.

2. Description of the Prior Art

Cloth is usually woven with warp and weft. In order to avoid raveling at cloth corners, a reinforced stitched portion along the adjacent edges of a cloth corner is often required. This is particularly true for plastic cloth and canvas used for many tents and covers, of which the corner edges 1 and 2, as shown in FIG. 1, are always folded over and stitched thereat with an opening 3 provided in the corner and a grommet 4 fixed therein for allowing a cord to be inserted into the grommet 4 and tied at a support. However, as the opening 3 mars the warp and weft structure of the cloth, when the grommet 4 is subjected to pull and drag force, the periphery of the opening 3 will become ravelled and eventually break loose, causing the grommet 4 to come out from the opening 3. In order to overcome the above-mentioned shortcoming, some manufacturers have made an effort to inset a side string 5 along the adjacent cloth edges 1 and 2 for increasing the tensile strength of the cloth edges 1 and 2. However, owing to the different ways of tying the cord, the opening 3 of the cloth will be damaged. If the cord 6 is tied as a square knot, as shown in FIG. 2A, with two portions of the cord 6 respectively kept in close engagement with the side string 5 at two sides 1 and 2, when the cord 6 is tightened, the tensile pull of the cord 6 will be evenly provided by the two portions of the cord 6 at both sides 1 and 2 of the cloth; thus, the strain suffered by both the opening 3 and the grommet 4 can be decreased. However, if the cord 6 is tied in any simple knot, as it is often done by some careless people, with the cord 6 looped at either one side or at the center of the corner of the cloth as shown in FIG. 2B, when the cord 6 is tightened, the tensile pull of the cord 6 will be completely absorbed by both the opening 3 and the grommet 4, so that the latter may easily be damaged and come off form the cloth. For alleviating the effects of the above-said defect, some manufacturers have stitched a triangular cloth piece 7 at the cloth corner, as shown in FIG. 1, for reinforcing the area where the grommet 4 is fixed in the opening 3. Nevertheless, the stitching operation of the triangular cloth piece in cloth, particularly for the bulky plastic cloth and canvas used for tents and covers is rather troublesome because not only is the side folding operation for a bulky weight cloth difficult, but also an additional two or three assistants are needed to help the sewing operator in moving the cloth during stitching, especially in turning at the cloth corner. In addition to the above-noted problem, as the reinforced triangular cloth piece 7 has to be aligned with the cloth corner, adjustment must be constantly made while stitching, wasting time in the stitching work. Despite the reinforced triangular cloth piece 7, if the cord 6 is tied in a single knot as shown in FIG. 2B, damage of the opening 3 and loosening of the gromment 4 will surely occur. At present, although further improvement has been tried to bond together the reinforced triangular cloth piece and the folded edges of the cloth through thermo-pressure bonding opration instead of traditional stitching, this improvement also encounters a serious problem; i.e. the total thickness of the bulky layers to be bonded by thermo-pressure bonding. The folded edges of the cloth are of a certain thickness, which together with the reinforced triangular cloth piece, formed of a folded square cloth piece, makes the total thickness exceed the bonding capability of a high-frequency bonding machine or other thermo-pressure bonding machine. On the other hand, if the corner edges of the plastic cloth or canvas are bonded through high-frequency or thermo-pressure bonding without the reinforced triangular cloth piece (to avoid excessive thickness), the cloth corner and the cloth surface are easily damaged as noted hereinbefore.

SUMMARY OF THE INVENTION

Objects of the Invention

It is accordingly a pimary object of this invention to provide a stitchless reinforced corner structure for cloth, which reinforced corner structure can be easily fitted in a piece of cloth so as to meet the requirement of complete production automation and reduced working time.

It is another object of this invention to provide a stitchless reinforced corner structure for cloth, by which reinforced corner structure, a grommet to be fixed in the cloth corner can be consolidated into a unified portion with the adjacent edges thereof so as to enable the corner to sustain a cord tied in any way thereat without incurring damage to the cloth corner and the grommet.

It is a further object of this invention to provide a stitchless reinforced corner structure for cloth whereby, when a cord is installed in the cloth corner and tied to a support, the tensile pull of the cord can be evenly distributed so as to ensure the life expectancy of the cloth.

FEATURES OF THE INVENTION

These and other objects of this invention are achieved by providing a stitchless reinforced corner structure, which reinforced corner structure comprises a foldable interlining member made of tough plastic material and integrally formed by injection, with folding lines provided on a surface of the interlining member, defining a middle region, a left region and a right region, which foldable interlining member can be folded into a triangular shape with orifices and stubs respectively provided in the three regions for being closely engaged to tightly secure a double-layered cloth corner in position, and an opening provided in the interlining member for being fitted with a grommet; thereby, a quick and strong reinforced cloth corner suitable for all supporting purposes can be achieved accordingly.

Other features and advantages of this invention will become more apparent in the following detailed description of a preferred embodiment when read in conjunction with the accompanying drawings.

DETAILED DESCRIPTION OF THE PREFERRED EMBODIMENTS

Figure 1:
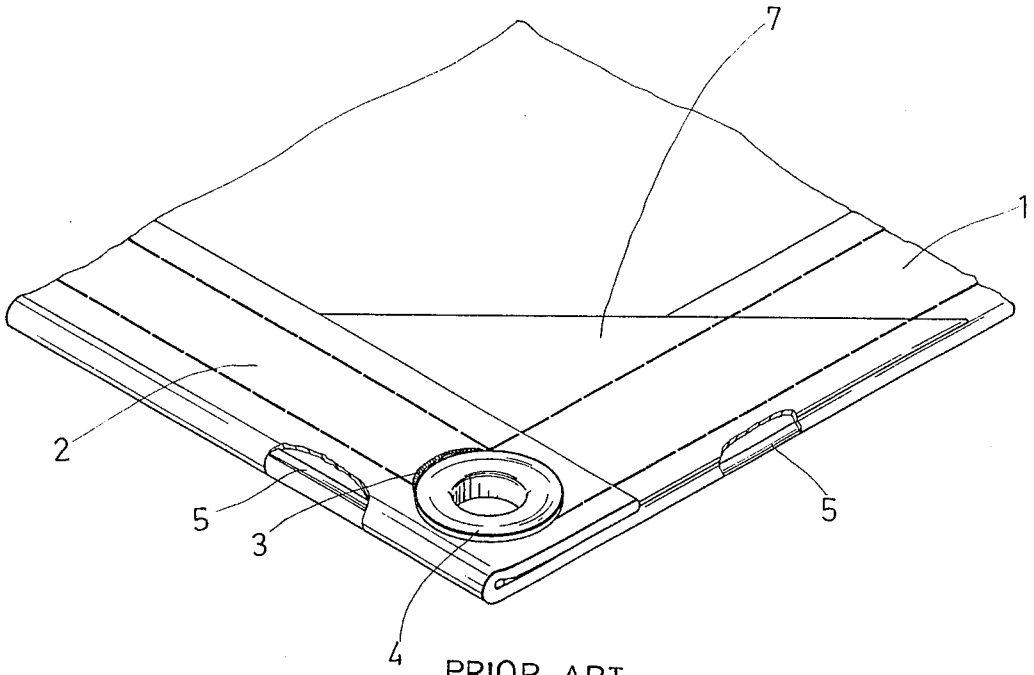
PRIOR ART FIG.1
FIG. 1 is an illustrative view of a known stitched reinforced corner structure for cloth.
Figure 2A:
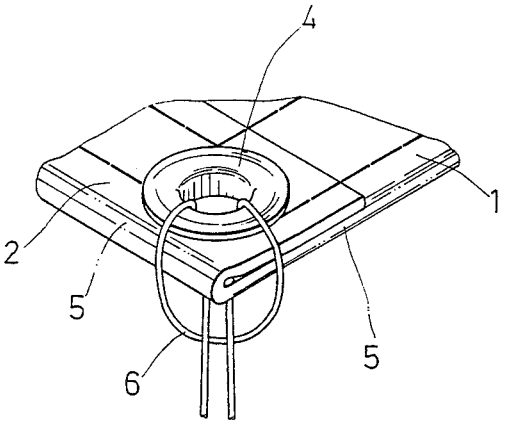
PRIOR ART FIG. 2(A)
FIG. 2A is an illustration of the known reinforced corner structure with a cord tied in a square knot through a grommet fixed in the corner.
Figure 2B:
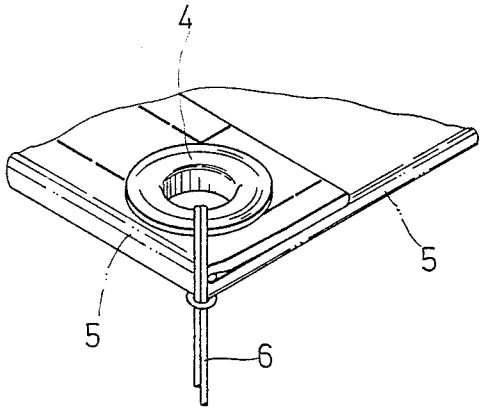
PRIOR ART FIG. 2(B)
FIG. 2B is an illustration of the known reinforced corner structure with a cord tied in a single knot through a grommet fixed in the corner.
Figure 3:
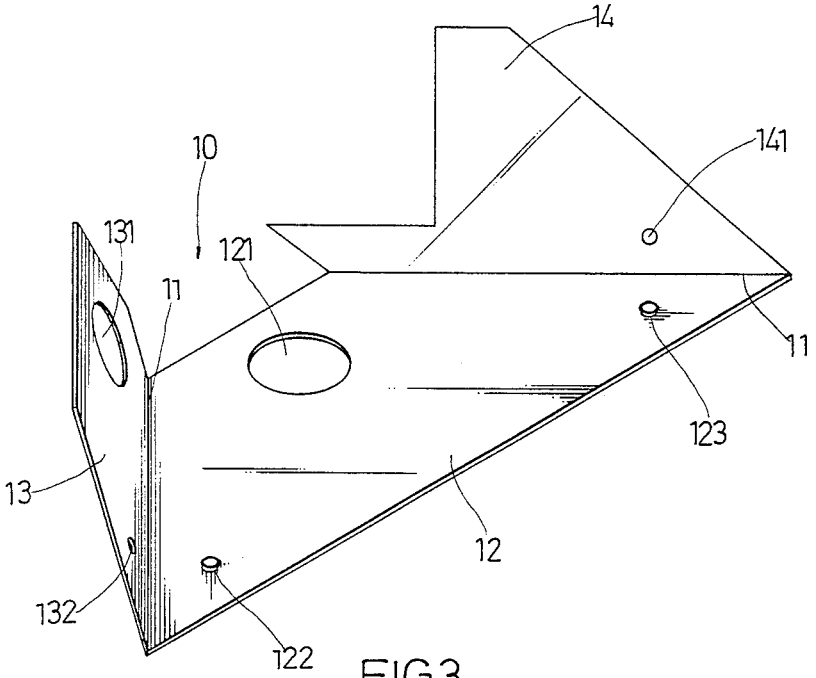
FIG. 3 is a perspective view of a preferred embodiment of a reinforced corner structure in an unfolded condition according to this invention.
Figure 4:
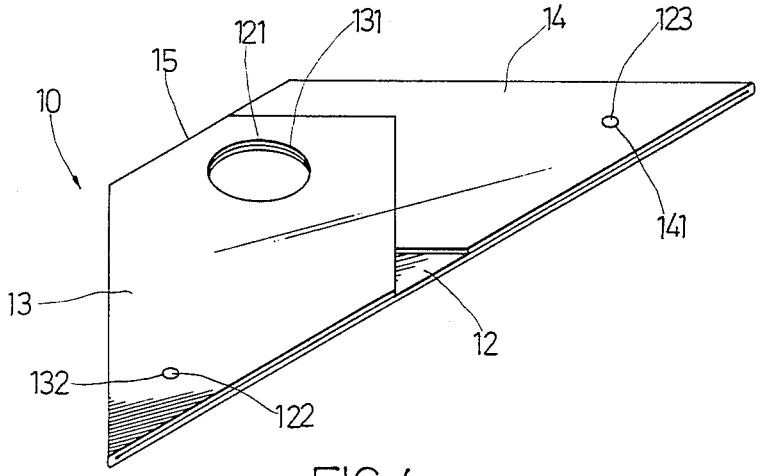
FIG. 4 is an illustrative view of the preferred embodiment of FIG. 3 in an assembled condition.

Referring to FIG. 3, there is shown a preferred embodiment of a stitchless reinforced corner structure for cloth according to this invention, which corner structure comprises an interlining member 10, which is integrally formed by injection of a tough plastic material. Two folding lines 11 are separately provided on the surface of the interlining member 10 with three regions—a middle region 12, a left region 13 and a right region 14 formed thereon. The left and right regions 13, 14 can be folded over the middle region 12 along the two folding lines 11 with an folded area formed by the left and right regions 13, 14 exactly corresponding (in shape) to that of the middle region 12. An annular opening 121, in an upper portion of the middle region 12, and two stubs 122 and 123, on a lower portion of the middle region 12, forming an angular shape with the annular opening 121 are respectively provided in the middle region 12. A round opening 131 corresponding in size to that of the annular opening 121 is provided in an upper part of the left region 13 for being superposed on the annular opening 121 when the left region 13 is folded over the middle region 12. Two orifices 132 and 141 corresponding to the stubs 122, 123 are provided respectively, on a lower part of the left and right regions 13 and 14 for being engaged with the related stubs 122 and 123 when the left and right regions 13, 14 are folded over the middle region 12 with a clearance 15 defined between the left and right regions 13 and 14, and the middle region 12, as shown in FIG. 4, for the passage of cloth.

Figure 5A:
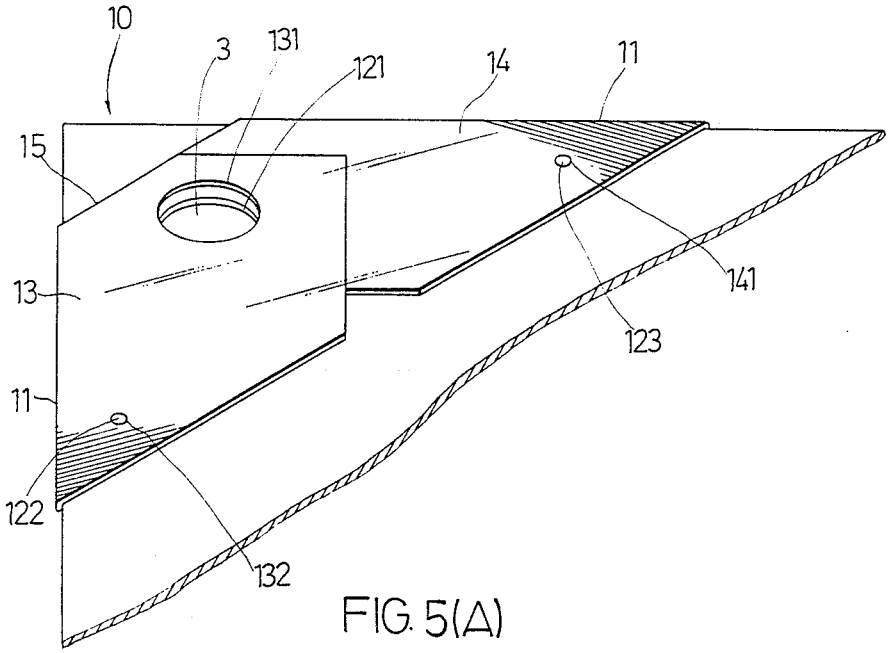
FIGS. 5A and 5B are illustrative views of the preferred embodiment used on cloth.
Figure 5:
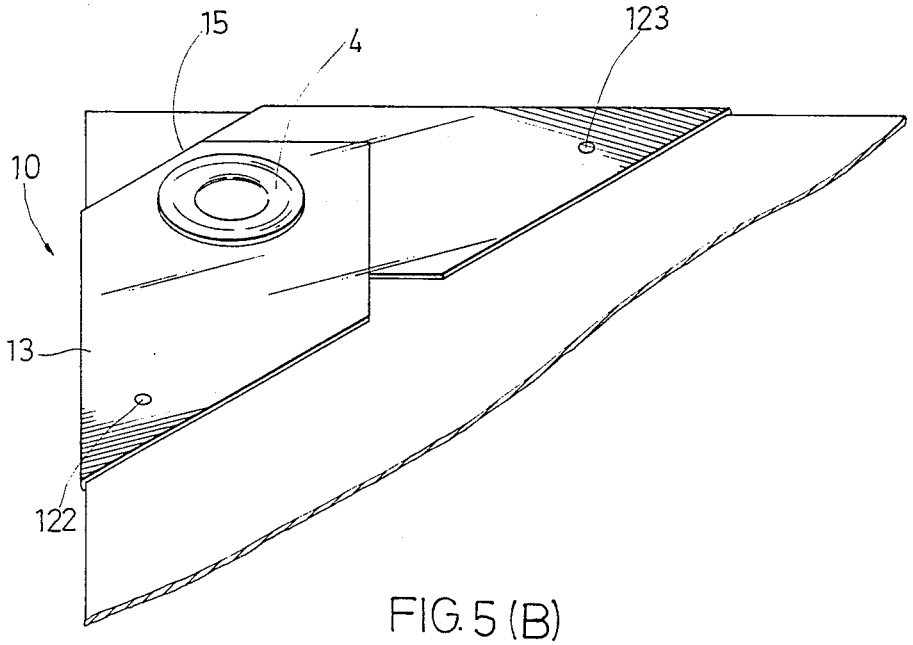

Referring to FIG. 5, before the reinforced corner structure of this invention is utilized on cloth (especially plastic cloth, canvas, etc.), the edges of the cloth, as usual, are folded for being stitched or bonded together through a high-frequency (thermopressure) operation with an opening 3 provided at a proper place in the cloth corner for fitting a grommet 4 therein. This preparatory work of the cloth saves a lot of time compared with the conventional work needed for having the cloth ready to be stitched for the reinforced corner structure. The work is performed in an integrated operation without interruption, and the reinforced corner structure according to this invention can be easily assembled on the cloth corner as a last stage, by skilled personnel. As shown in FIG. 5A, the middle region 12 of the interlining member 10 is placed beneath the cloth corner portion, the left and right regions 13, 14 are folded over the cloth corner portion along the folding lines 11 of both regions 13 and 14 with the openings 131, 121 aligned with the opening 3 of the cloth corner portion, and then the interlining member 10 is pressed against the cloth corner received in the clearance 15 of the interlining member 10 by a pressing machine (not shown) with the orifice 141 and the stub 123 and the orifice 132 and the stub 122 closely engaged with each other, and the openings 131, 121 of the left and right regions 13, 14 and the opening 3 of the interlining member 10 also in exact alignment thereat. Finally, a grommet 4 is fitted in the interposed openings 3, 131, 121, as shown in FIG. 5B, and the stitchless reinforced corner structure of cloth is completed.

It shall be appreciated that since the folding of the interlining member 10 defines a clearance 15 between the folded left and right regions 13, 14 and the middle region 12, the cloth corner can be easily adjusted in position therein in conjunction with the openings 121, 131, and 3 and the orifices 132, 141 and the stubs 122 and 123. Moreover, since the grommet 4 is fixedly fastened on the openings 131 and 121 of the interlining member 10, the dragging force coming from the cord tied through the grommet 4 will not be directly applied to the opening 3 of the cloth corner. Therefore, no loosening occurs of the warp and weft of the cloth corner and the grommet 4 will not come off, and the reinforced corner structure can evenly support the tensile strength of the cloth with great stability and security.

Figure 6:
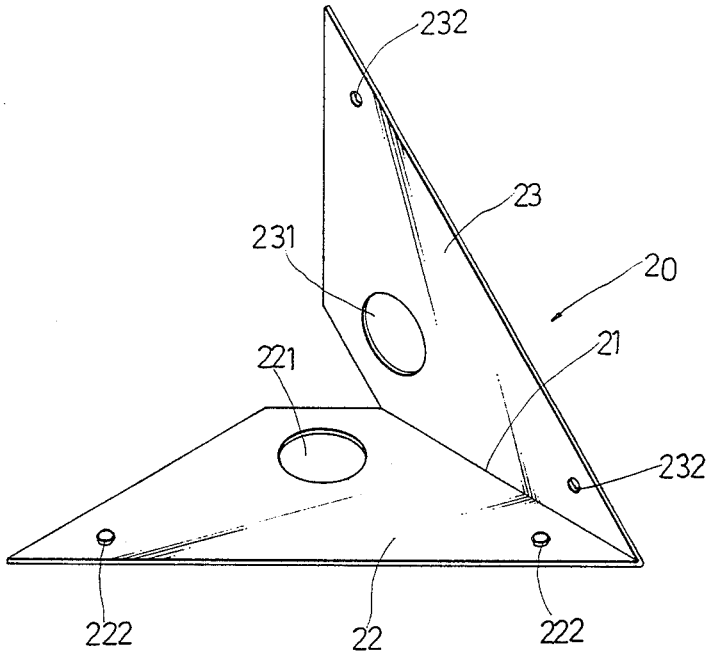
FIG. 6 is a perspective view of another preferred embodiment of a reinforced corner structure in a developed condition according to this invention.
Figure 7:
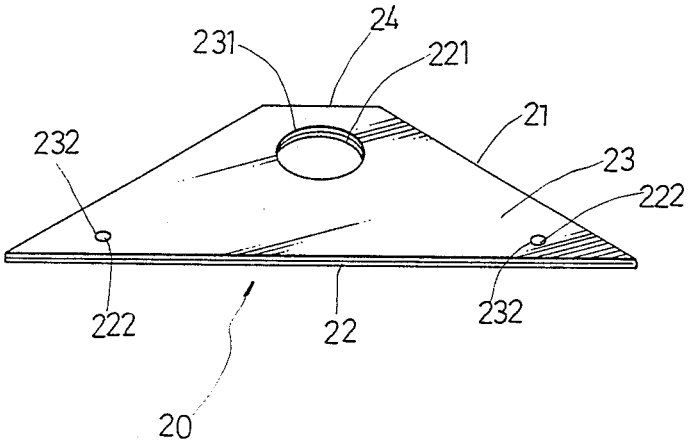
FIG. 7 is an illustrative view of the preferred embodiment of FIG. 6 in an assembled condition.

Referring to FIG. 6, there is shown another example of the reinforced corner structure according to this invention, which reinforced structure also comprises an interlining member 20 integrally formed by injection with plastic or other tough material, and made in a butterfly shape. A folding line 21 is provided in the middle, defining a left region 22 and a right region 23, both of which are in trapezoidal form, and each region has an annular opening 221, 231 provided in an upper portion thereof, corresponding to each other. A pair of stubs 222 are separately provided at a lower portion of the left region 22; while, a pair of orifices 232 are respectively formed in the lower portion of the right region 23, corresponding to the stubs 232. When the two regions 22 and 23 are folded together, as shown in FIG. 7, a clearance 24 is also formed therebetween for permitting the cloth corner to be adjusted in position according to the location of the openings 221, 231 and the opening 3 of the cloth corner. The assembly and advantages of this embodiment are the same as those of the preferred embodiment described hereinbefore and illustrated in FIGS. 3 through 5.

Having thus described the invention, it is to be understood that many embodiments thereof will suggest themselves without departing from the scope of this invention. Therefore, it is intended that the specification and drawings be interpreted as illustrative rather than in a limiting sense.

What is claimed is:

1. A reinforced corner structure for cloth comprising: a foldable interlining member made of tough plastic material and integrally formed by injection, comprising a pair of folding lines separately provided on a surface of said interlining member dividing said interlining member into three regions, a middle region, a left region and a right region, wherein each of said left and middle regions has an annular opening provided in an upper portion, corresponding to each other, and said left and right regions can be folded over said middle region so as to form a consolidated truncated triangle-shaped interlining member with a clearance defined between said regions for allowing a cloth corner to be adjusted therein before being pressed together therewith;

whereby, a strong and durable stitchless reinforced corner structure can be achieved for evenly supporting the tensile strength of the cloth corner.

2. A reinforced corner structure according to claim 1 wherein said interlining member further comprises a pair of stubs separately provided at a lower portion of said middle region, and a pair of orifices corresponding to said stubs respectively provided in a lower portion of said left region and right region, so that, when said left and right regions are folded over said middle region, said stubs can be suitably engaged in said orifices so as to keep the cloth corner in position tightly upon the cloth and the interlining member being pressed together, eliminating the need for stitching other.

3. A reinforced corner structure for cloth comprising: a foldable interlining member made of tough plastic material and integrally formed by injection, comprising a folding line provided on a surface of said interlining member and dividing said interlining member into a left region and a right region congruent to each other, wherein each of said left and right regions has an annular opening provided in an upper portion, corresponding to each other, and said left and right regions are folded together so as to uniformly align said annular openings and to form a consolidated truncated triangle-shaped interlining member with a clearance defined between said regions for allowing a cloth corner to be adjusted therein before being pressed together therewith; whereby a strong and durable stitchless reinforced corner structure can be achieved for evenly supporting the tensile strength of the cloth corner.

4. A reinforced corner structure according to claim 3 wherein said left region includes a pair of stubs separately provided at a lower portion thereof, and said right region includes a pair of orifices respectively provided in a lower portion thereof, corresponding to said stubs, so that, when said left and right regions are pressed together, said stubs and orifices can be closely engaged with each other for tightly securing the cloth corner in position therein.

* * * * *

UNITED STATES PATENT AND TRADEMARK OFFICE

CERTIFICATE OF CORRECTION

PATENT NO. : 4,777,071

DATED : October 11, 1988

INVENTOR(S) : Cho Liu

It is certified that error appears in the above-indentified patent and that said Letters Patent is hereby corrected as shown below:

On the Title page, item [76], inventor: Cho Liu" should be --Chu Liu --.

Signed and Sealed this

Thirtieth Day of November, 1993

*Attest:*

*Attesting Officer*

BRUCE LEHMAN

*Commissioner of Patents and Trademarks*